US005548309A

United States Patent [19]

Okubo et al.

[11] Patent Number: 5,548,309

[45] Date of Patent: Aug. 20, 1996

[54] APPARATUS AND METHOD FOR WIPING AN INK JET RECORDING HEAD WITH CONTROL OF RELATIVE SPEED BETWEEN WIPER AND HEAD

[75] Inventors: Akio Okubo, Tokyo; Atsushi Saito, Yokohama; Fumihiko Watanabe, Tokyo, all of Japan

[73] Assignee: Canon Kabushiki Kaisha, Tokyo, Japan

[21] Appl. No.: 737,657

[22] Filed: Jul. 30, 1991

[30] Foreign Application Priority Data

Aug. 3, 1990 [JP] Japan ..... 2-206996
Nov. 29, 1990 [JP] Japan ..... 2-326028

[51] Int. Cl.[6] ..... B41J 2/165

[52] U.S. Cl. ..... 347/33

[58] Field of Search ..... 346/140 R, 1.1; 347/13, 22, 29, 33, 38, 39

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,723,129 | 2/1988 | Endo et al. | 346/1.1 |
| 4,740,796 | 4/1988 | Endo et al. | 346/1.1 |
| 5,097,276 | 3/1992 | Midorikawa | 346/140 R |
| 5,115,250 | 5/1992 | Harmon et al. | 346/1.1 |
| 5,126,765 | 6/1992 | Nakamura | 346/140 R |
| 5,266,974 | 11/1993 | Koitabashi et al. | 347/33 |

FOREIGN PATENT DOCUMENTS

| | | | |
|---|---|---|---|
| 0335699 | 3/1989 | European Pat. Off. . | |
| 0323261 | 6/1989 | European Pat. Off. . | |
| 3510262 | 9/1986 | Germany . | |
| 54-056847 | 2/1979 | Japan . | |
| 58-094472 | 11/1983 | Japan . | |
| 59-123670 | 3/1984 | Japan . | |
| 59-138461 | 4/1984 | Japan . | |
| 60-071260 | 2/1985 | Japan . | |
| 62-111751 | 5/1987 | Japan | B41J 3/04 |

*Primary Examiner*—Nancy Le
*Assistant Examiner*—David Yockey
*Attorney, Agent, or Firm*—Fitzpatrick, Cella, Harper & Scinto

[57] ABSTRACT

A wiping apparatus for a recording head of an ink jet recording apparatus, which has a recording head including an ink ejection portion, includes a wiping member, and a rotation device for rotating the recording head and/or the wiping member so that the wiping member slides on the ink ejection portion. The apparatus prevents the splash of ink caused when the wiping member leaves the ink ejection portion by using one of the following techniques: First, a wiping speed is decreased at the end of wiping; second, an angle between the wiping member and the ink ejection portion is declined as the wiping proceeds; third, the first and second techniques are combined; and fourth, an approach amount of the wiping member to the ink ejection portion is reduced at least just before the wiping member leaves the ink ejection portion. Using one of these technique enables the wiping member to leave softly the ink ejection portion by weakening the restoring force of the wiping member, thereby preventing ink from splashing into the surroundings during the wiping operation.

31 Claims, 6 Drawing Sheets

APPARATUS AND METHOD FOR WIPING AN INK JET RECORDING HEAD WITH CONTROL OF RELATIVE SPEED BETWEEN WIPER AND HEAD

BACKGROUND OF THE INVENTION

1. Field of the Invention

The present invention relates to a wiping apparatus and method of a recording head of an ink jet recording apparatus for recording information on a recording medium by ejecting ink from ink ejection orifices.

2. Description of the Prior Art

Many ink jet recording apparatuses of this type are provided with a wiper that wipes an ink ejecting portion of a recording head so as to remove ink drops or dust sticking thereto, thus maintaining reliable printing or image recording. The wiper is made of rubber or the like, and the wiping is carried out as needed before or after a recovery operation of the recording head, such as suction or idle ejection of ink.

In particular, in a serial printer which performs recording by scanning a recording head perpendicularly to the sheet transport direction using a carriage, there is used such a wiper that wipes the ejection orifices of the head by projecting toward the head moving to the wiper so that the wiping is carried out by utilizing the moving speed of the carriage. In this case, the wiper is installed close to an end of a platen for supporting the recording medium. Wipers of this type are widely used because they are inexpensive and reliable. For example, Japanese laid-open patent application No. 58-94472 (1983) discloses a technique that has a cleaner (a wiper) that moves to and fro with respect to a recording head, and reduces the speed of the recording head when the head enters the cleaning position to slide on the wiper. Thus, by reducing the carriage speed from high speed recording, the wiper can remain continually in contact with the recording head.

The prior art, however, presents a problem in that wiped off ink splashes from the tip of the wiper to the surroundings so that a recording sheet or the apparatus may be spotted when the wiper slips off the ink ejection portion of the head at the final stage of the wiping operation. This is because the contact state between the wiper and the recording head is maintained constant, and only the relative speed between the two is once changed when the head enters the cleaning position.

SUMMARY OF THE INVENTION

Accordingly, it is an object of the present invention to provide a wiping apparatus and method of a recording head of an ink jet recording apparatus, which can eliminate the above-described disadvantage associated with the conventional technique, thereby preventing ink from splashing during the wiping operation of a recording head.

In the first aspect of the present invention, a wiping apparatus of a recording head of an ink jet recording apparatus, the recording head including an ink ejection portion and ink ejection orifices arranged on the ink ejection portion for ejecting ink from the ink ejection orifices to a recording medium, the wiping apparatus comprises:

wiping means made of an elastic material for wiping the ink ejection portion by sliding a tip of the wiping means on the ink ejection portion;

rotation means for rotating the recording head and/or the wiping means so that the wiping means slides on the ink ejection portion to wipe the ink ejection portion; and control means for changing a drive speed of the recording head or the wiping means by controlling the rotation means during wiping of the ink ejection portion.

Here, the control means may reduce the drive speed in a latter part of the wiping of the ink ejection portion.

In the second aspect of the present invention, a wiping apparatus of a recording head of an ink jet recording apparatus, the recording head including an ink ejection portion and ink ejection orifices arranged on the ink ejection portion for ejecting ink from the ink ejection orifices to a recording medium, the wiping apparatus comprises:

wiping means made of an elastic material for wiping the ink ejection portion by sliding a tip of the wiping means on the ink ejection portion; and rotation means for rotating the recording head and/or the wiping means so that the wiping means slides on the ink ejection portion to wipe the ink ejection portion;

wherein the rotation means rotates the wiping means and/or the recording head so that an angle between the wiping means and the ink ejection portion is declined as the wiping proceeds.

Here, the rotation means may rotate the wiping means and/or the recording head so that an angle between the wiping means and the ink ejection portion is declined as the wiping proceeds.

The recording head may be a full-line type in which the ink ejection orifices are aligned in full length across the recording medium.

The recording head may comprise energy converting means for expelling ink to the recording medium, the energy converting means composed of electrothermal converting elements each of which produces thermal energy and develops a bubble in the ink by using the thermal energy so that pressure change caused by the bubble forces the ink to be expelled.

The recording head may make contact with the wiping means when the recording head is moving from a position where the recording head faces a cap member covering the ink ejection portion to a position where the recording head faces the recording medium.

In the third aspect of the present invention, a wiping apparatus of a recording head of an ink jet recording apparatus having a recording head including an ink ejection portion and ink ejection orifices arranged on the ink ejection portion for ejecting ink from the ink ejection orifices to a recording medium, the wiping apparatus comprises:

wiping means made of an elastic material for wiping the ink ejection portion by sliding a tip of the wiping means on the ink ejection portion;

rotation means for rotating the recording head and/or the wiping means so that the wiping means slides on the ink ejection portion to wipe the ink ejection portion; and control means for changing an amount of approach of the wiping means to the ink ejection portion during the wiping means wipes the ink ejection portion.

Here, the control means may reduce the amount of approach of the wiping means to the ink ejection portion at least immediately before the wiping means leaves the ink ejection portion.

The recording head may comprise energy converting means for expelling ink to the recording medium, the energy converting means composed of electrothermal converting elements each of which produces thermal energy and develops a bubble in the ink by using the thermal energy so that pressure change caused by the bubble forces the ink to be expelled.

In the fourth aspect of the present invention, a wiping method of a recording head of an ink jet recording apparatus which includes a recording head and a wiping member, the recording head having an ink ejection portion and ink ejection orifices arranged on the ink ejection portion, the wiping method comprises the steps of:

rotating said wiping member and/or the recording head so that the wiping member wipes the ink ejection portion at a first wiping speed; and reducing the first wiping speed to a second wiping speed lower than the first wiping speed at least immediately before the wiping member slips off said ink ejection portion.

In the fifth aspect of the present invention, a wiping method of a recording head of an ink jet recording apparatus which includes a recording head and a wiping member, the recording head having an ink ejection portion and ink ejection orifices arranged on the ink ejection portion, the wiping method comprises the steps of:

rotating the wiping member and/or the recording head so that the wiping member wipes the ink ejection portion; and declining an angle between the wiping member and the ink ejection portion as the wiping proceeds.

In the sixth aspect of the present invention, a wiping method of a recording head of an ink jet recording apparatus which includes a recording head and a wiping member, the recording head having an ink ejection portion and ink ejection orifices arranged on the ink ejection portion, the wiping method comprises the steps of:

rotating the wiping member and/or the recording head so that the wiping member wipes the ink ejection portion; and declining an amount of approach of the wiping member to the ink ejection portion as the wiping proceeds.

The ink jet recording apparatus of the present invention has the rotation means for rotating the recording head and/or the wiping means. By rotating the recording head and/or the wiping means, the wiping means slides on the ink ejection portion of the head so as to wipe off ink remaining on the ink ejection portion. The rotation speed of the recording head and/or the wiping means can be varied during wiping by the control means that controls the rotation means. This enables the wiping means to leave the ink ejection portion softly, thereby preventing the wiped ink from splashing to the surroundings, and hence preventing spots of ink on the recording medium, or faults of electric wiring or optical system due to ink contaminants. Furthermore, since the wiping speed is maintained at a relatively high speed in the other part of wiping, the total time required for the wiping can be maintained short. This is a preferable feature for an apparatus as a facsimile where the wiping time is restricted by communication protocol.

The present invention can achieve similar effect by declining the angle between the wiping means and the ink ejection portion during the wiping. Moreover, combination of changing the wiping speed and declining the angle can achieve further positive effect.

The present invention can achieve further effect by changing the approach amount of the wiping means to the ink ejection portion. In this case, the approach amount is decreased at least immediately before the wiping means leaves the ink ejection portion so as to soften the leaving action.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

The invention will now be described with reference to the accompanying drawings.

Embodiment 1

Figure 1:
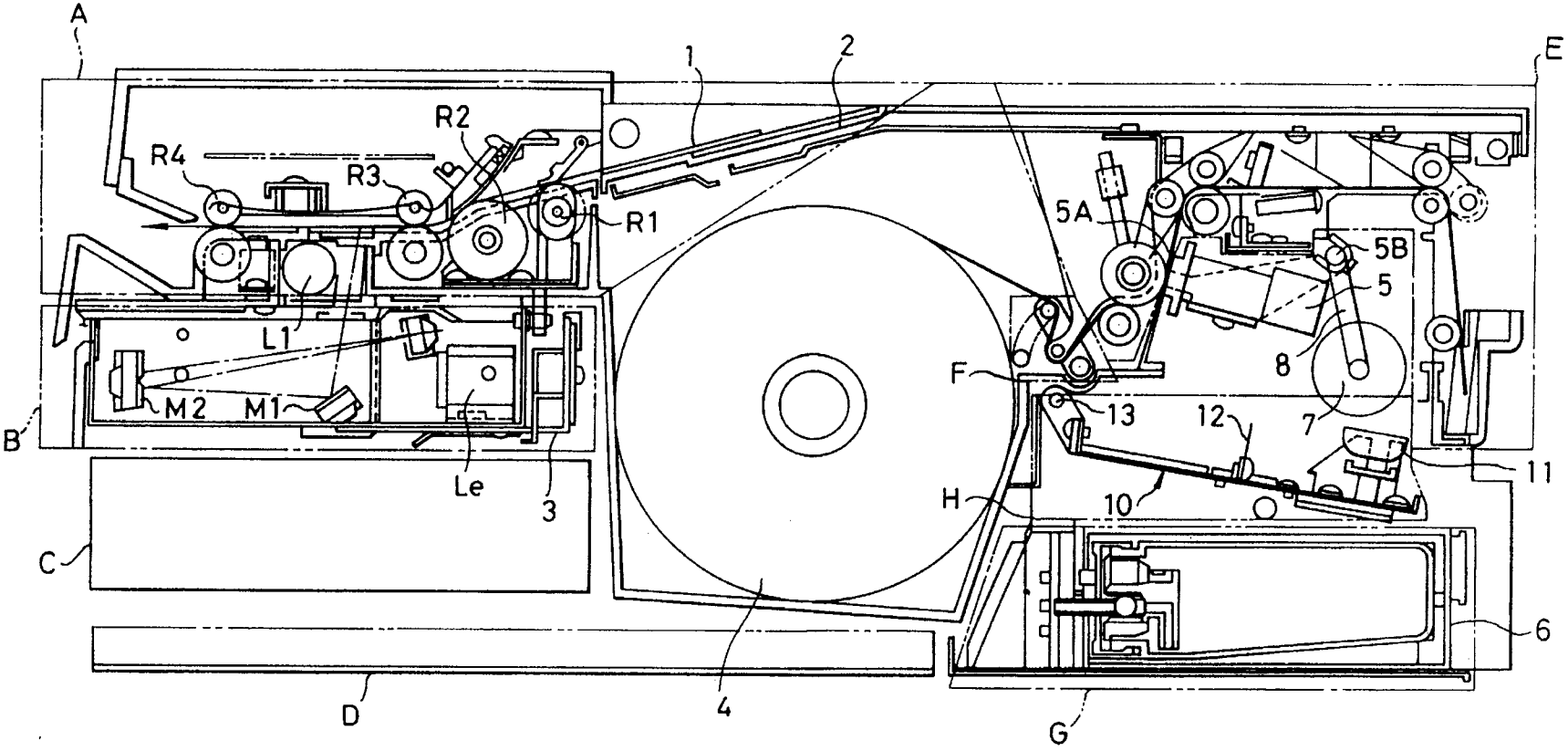
FIG. 1 is a sectional view showing an arrangement of a facsimile apparatus to which the present invention is applied.

FIG. 1 shows a facsimile apparatus to which the present invention is applied. The facsimile apparatus is roughly classified into eight subassemblies as blocked by phantom lines: a document transport system A; an optical system B; a power supply C; an electric circuit board D; a recording paper transport system E; a decurl system F; an ink feeding system G; and a recovery system H. The document transport system A and the optical system B constitute a document reading portion that reads a document image from a document 1.

The basic operation of the facsimile apparatus is as follows: The document 1 to be transmitted or copied is placed on a document feeder tray 2 of the document transport system A. Then, the document 1 is conveyed in the direction of the arrow by a train of rollers R1, R2, R3 and R4 driven by a drive means not shown. During conveyance, the information on the document 1 is read by a line CCD 3 provided at a predetermined document reading line position (i.e., a main scanning line position). In this case, the information is transferred through a reflecting path of the optical system B (a lamp L1 and mirrors M1 and M2), and is focused on the line CCD 3 by a focusing lens Le. The line CCD 3 converts the information into an electric signal.

In a receiving or copying operation, the recording paper transport system E carries a recording sheet 4 fed from a roll of paper along bold lines in FIG. 1 by using a train of rollers driven by a drive means not shown. In the course of the transportation, a head unit 5 ejects ink from its ink ejection orifices and records document information on the sheet 4 at a predetermined recording line. The head unit 5 ejects ink by utilizing electrothermal converting elements (not shown) which produce thermal energy to develop bubbles in the ink, thus expelling ink droplets by pressure changes of the bubbles.

The power supply C converts an AC input power into various forms of power, and supplies them to necessary portions. The electric circuit board D has a circuit including a micro-computer system and its peripherals to control the functions and operations of various portions of the apparatus. In addition, the circuit board D includes a circuit for connecting or disconnecting a transmission line, and a circuit for inputting or outputting image information signals. The ink feeding system G has an ink cassette 6 that supplies ink to the head unit 5. The recovery system H has a cleaning means and a capping means serving to maintain reliable ejection of the head unit 5.

Next, a portion of the recovery system H and decurl system F that works in the recovery operation of the present invention will be described with reference to FIGS. 1 and 2A–2D. The head unit 5 is a so-called full-line head which has ink ejection orifices aligned in the full length across the recording sheet 4, and has a long thin shape extending normally to the surface of the sheet. The head unit 5 is mounted on a head shaft 5B in such a manner that it can rotate about the shaft 5B in its entirety. In FIG. 1, reference numeral 7 designates a stepper motor for rotating the head unit 5 about the head shaft 5B, and 8 denotes a drive belt for the rotation.

The recovery system H includes a cap unit 10 that carries out capping and wiping on the head unit 5. The cap unit 10 has a capping member 11 and a wiping member 12 arranged as shown in FIG. 2, and the capping member 11 has a sufficient size to cover the entire ink ejection portion 5A of the head unit 5. The cap unit 10 is swingably mounted on a frame shaft 13 fixed at an end of the cap unit 10.

The swing of the cap unit 10 is performed by a stepper motor (not shown in FIG. 2) provided in connection with the frame shaft 13. The drive timing and speed of the stepper motor for driving the cap unit 10 as well as the above-mentioned stepper motor 7 for rotating the head unit 5, are controlled by a control system described below.

Figure 3:
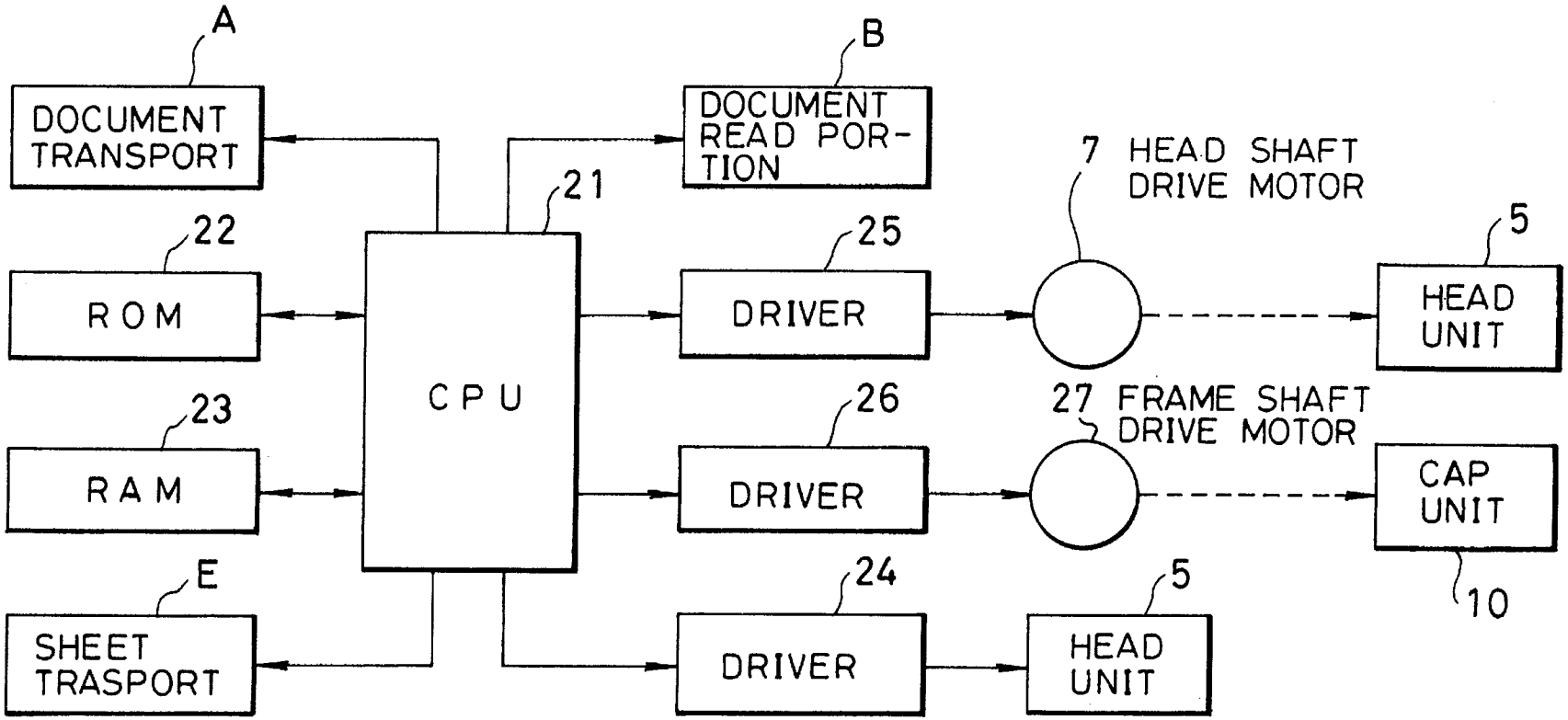
FIG. 3 is a block diagram showing an arrangement of a control circuit of the present invention.

FIG. 3 is a block diagram showing the control system of the ink jet recording apparatus according to the present invention. A CPU (Central Processing Unit) 21 controls the document reading of the optical system B, the recording of the head unit 5, various operations of the recovery system H, etc. To the CPU 21, are connected an ROM 22 and an RAM 23: the ROM 22 stores control procedures of respective operation modes and the like; and the RAM 23 is used for saving data read from the document 1 or data to be recorded on the sheet 4. With this arrangement, the CPU 21 controls reading of the document 1 and recording of the read information on the sheet 4 according to commands entered from a console (not shown). The reading is carried out by driving the document transport system A or the sheet transport system E, and by making the document reading portion (optical system) B read the document 1. The recording is performed by driving a head driver 24 on the basis of the read or received information, and by making the ink unit 5 eject ink.

In addition, the CPU 21 controls the capping operation and the recovering operation of the head unit 5 which are performed after recording operation or the like by driving the head shaft drive motor 7 via a driver 25 and a frame shaft drive motor 27 via a driver 26. The control procedures of these operations will be described referring to FIGS. 2A–2D and 4.

Figure 2A:
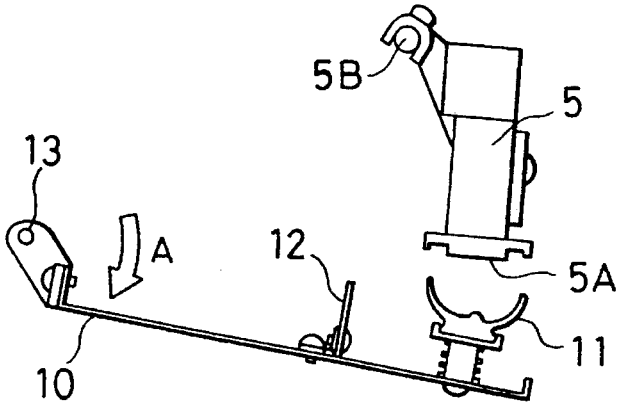
FIGS. 2A–2D are views illustrating a wiping operation of the present invention.

First, in the capping state, in which the head unit 5 is not in use and the recording is not performed, the head unit 5 is placed at a position shown in FIG. 2A with the cap member 11 covering the ink ejection portion 5A of the head unit 5. After the recovering operation, which expels the ink drops by bubbles out of the orifices on the ink ejection portion 5A, has been performed, the ink stuck to the ink ejection portion 5A must be wiped off. The wiping operation is carried out as follows by using the wiping member 12.

Figure 4:
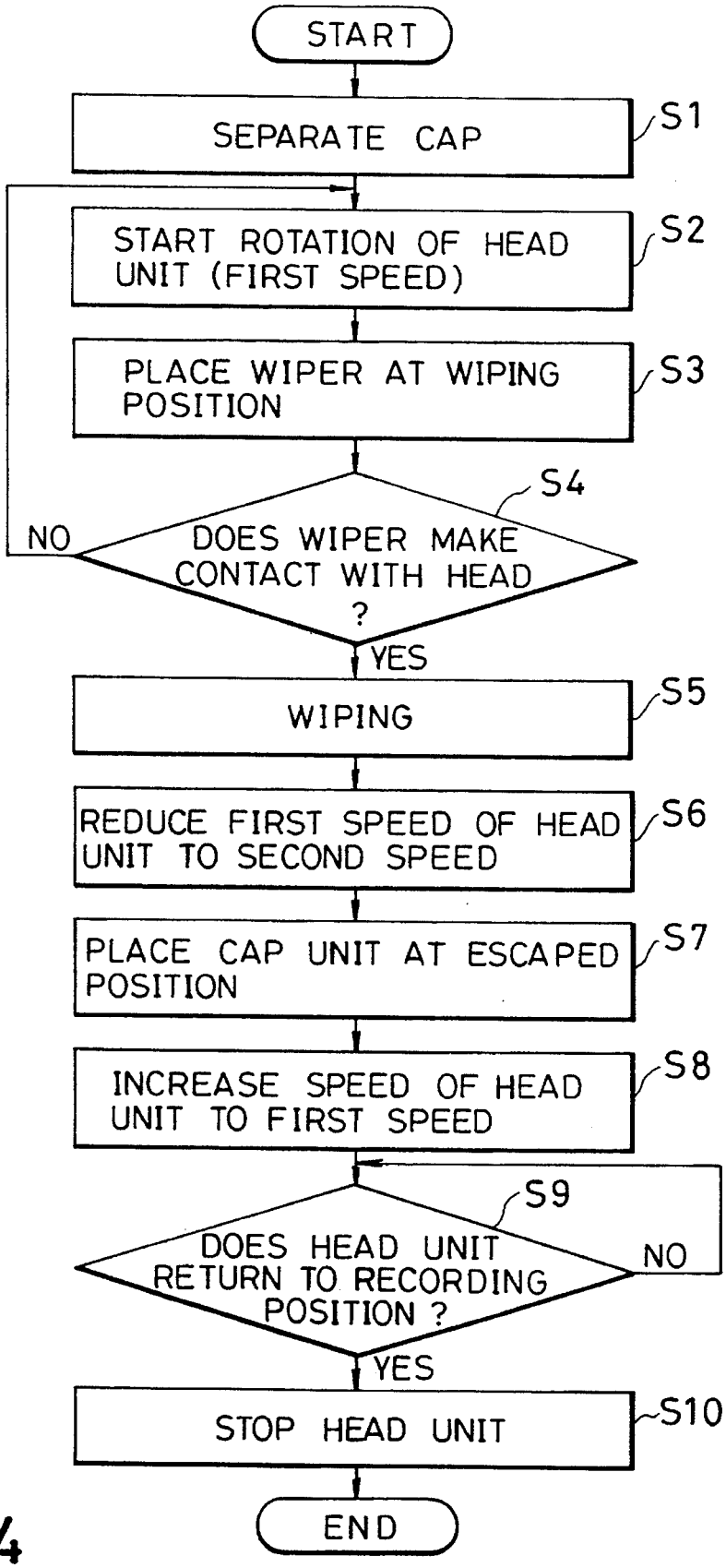
FIG. 4 is a flowchart illustrating the wiping control procedure of a first embodiment of the present invention.

FIG. 4 is a flowchart illustrating the wiping control procedure of the first embodiment. This procedure is started when a command that orders the recovering operation or wiping operation is entered into the CPU 21. At step S1, the CPU 21 drives the frame shaft drive motor 27 via the driver 26 so that the cap unit 10 is rotated in the direction indicated by the arrow A in FIG. 2A, and separates the cap member 11 from the ink ejection portion 5A of the head unit 5.

Figure 2B:
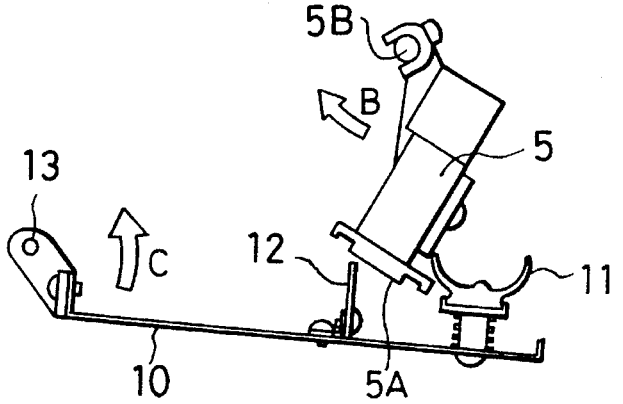
Figure 2C:
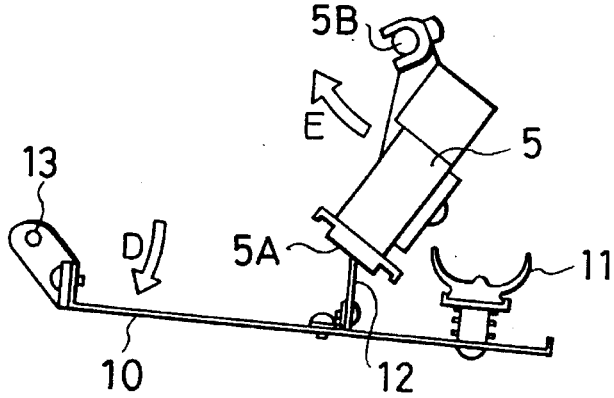

At the next step S2, the CPU 21 commands the driver 25 to drive the head shaft drive motor 7 at a first, comparatively high speed so that the head unit 5 is rotated in the direction indicated by the arrow B in FIG. 2B, and reaches the wiping position of the wiping member 12. At step S3, the cap unit 10 is rotated in the direction indicated by the arrow C of FIG. 2B, that is, in the direction from the cap member 11 to the recording region so that the wiper is positioned at the wiping position. At step S4, the CPU 21 waits until the wiping member 12 makes contact with the ink ejection portion 5A of the head unit 5. After that, at step S5, the wiping operation is carried out. In this case, the state of FIG. 2B is confirmed by a timer of the CPU 21, for example, and in addition, the state of FIG. 2C is confirmed in which a series of the ink ejection orifices is being wiped.

Then, at step S6, the CPU 21 commands the driver 25 to drive the head unit 5 via the head shaft drive motor 7 at a second speed lower than the first speed so that the wiping of the ink ejection portion 5A is carried out at the second speed. Thus, the wiping speed of the wiping means 12 is lowered so as to prevent ink spots from splashing into the surroundings, which otherwise would be caused by an abrupt slip of the wiper 12 off the ink ejection portion 5A. In particular, in the present embodiment, the wiping member 12 is placed apart from the recording sheet 4, and in addition, the head unit 5 is rotated in the direction from the cap member 11 to the recording region as indicated by the arrow E of FIG. 2C so that the ink will splash (if any) in the direction opposite to the recording sheet 4. This can eliminate the fear that the recording sheet 4 as well as the periphery members will be spotted by ink.

Figure 2D:
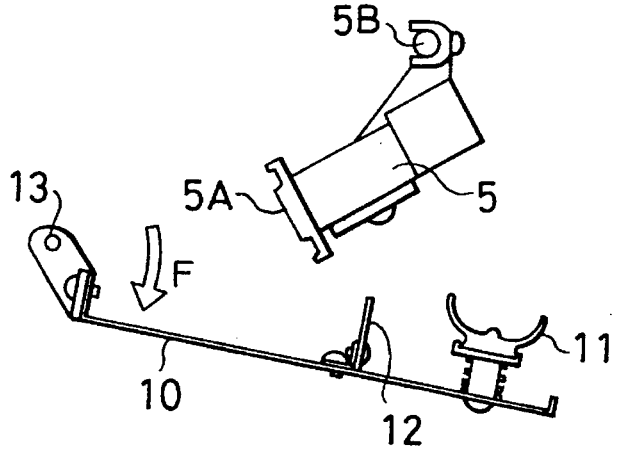

At step S7, after completing the wiping, the cap unit 10 is rotated to the escaped position as shown in FIG. 2D. Then, at step S8, the rotation speed of the head unit 5 is returned to the first, comparatively high speed so that the head unit 5 is set at the recording position as quickly as possible. When it is confirmed that the head unit is set at the recording position by a sensor or the like at step S9, the rotation of the head unit 10 is stopped at step S10, thus completing the wiping operation.

According to the first embodiment, since the head unit 5 and/or the cap unit 10 are rotated as shown in FIGS. 2A–2D so that an angle between the ink ejection portion 5A and the wiping member 12 declines, this angle at the end of wiping is less than that at the start of wiping (best shown in FIG. 2B). As a result, the ink is sprinkled less than when the angle does not decline.

Although in the description above, the wiping operation is performed after the recovery operation in which the ink is forced to be expelled from the ink ejection portion, the wiping operation can be carried out immediately before or during the recording so as to eliminate moisture on the ink ejection portion due to ink mist, or to remove contaminants accidentally sticking thereto. These wiping operations can be achieved in a manner similar to that described above, and so the description thereof is omitted here.

In addition, although in the first embodiment described above, the rotation speed of the head unit 5 is adjusted, the speed of the wiper 12 can be adjusted with the head unit 5 being stationed at the predetermined wiping position so that the wiper 12 moves in a manner corresponding to that of the unit head 5, thereby adjusting the relative speed between the wiper 12 and the ink ejection portion 5A.

Furthermore, the application of the present invention is not limited to the full-line ink jet recording head. The present invention can be applied to a serial type recording apparatus including a recording head moved by a carriage during recording, as long as the recording head or a wiper is rotated to carry out the wiping operation.

Embodiment 2

Figure 5:
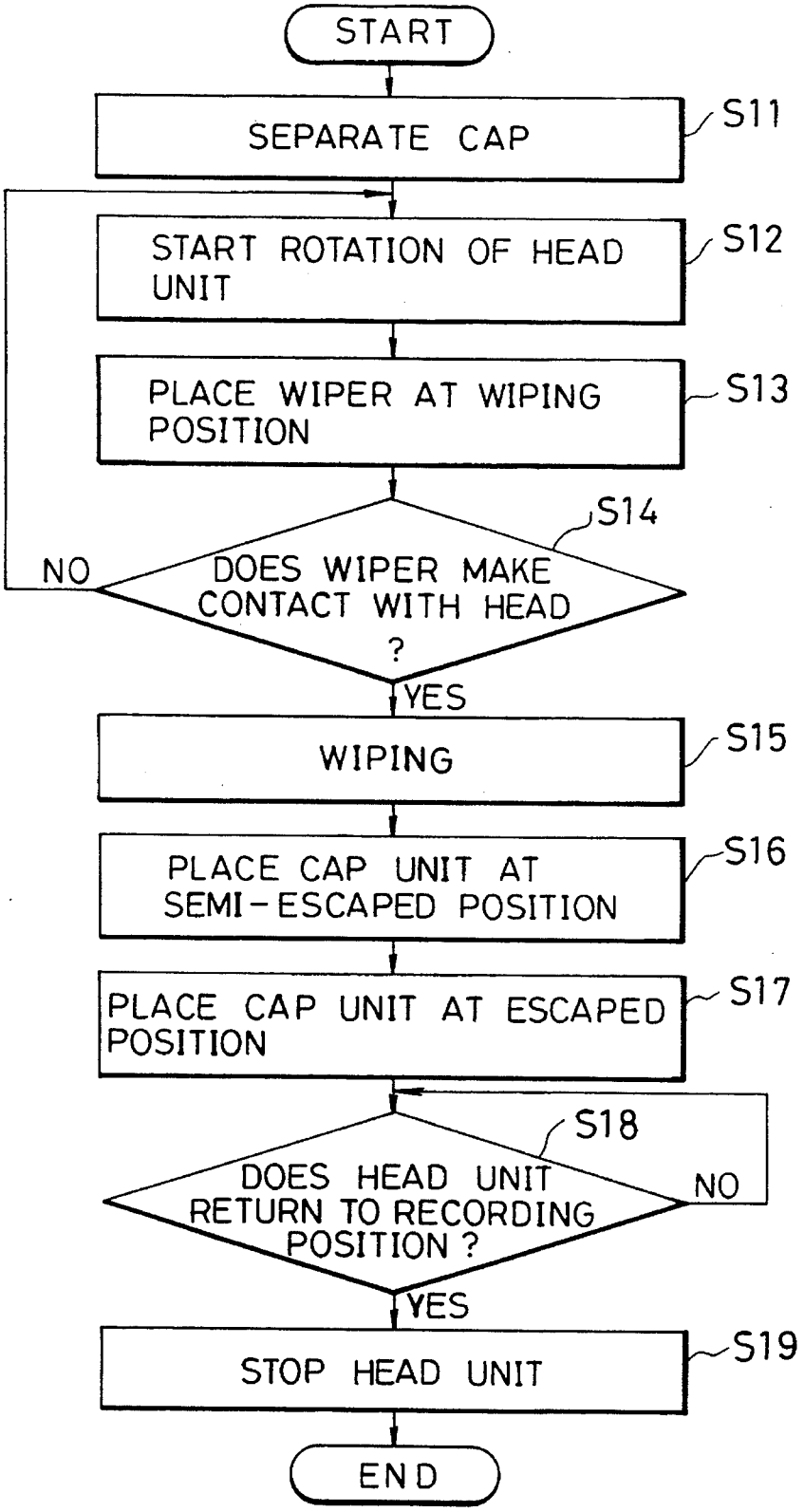
FIG. 5 is a flowchart illustrating the wiping control procedure of a second embodiment of the present invention.

FIG. 5 is a flowchart illustrating a wiping operation of a second embodiment of the present invention. An apparatus in which the wiping operation is carried out is similar to that of the first embodiment shown in FIGS. 1–4.

Figure 6A:
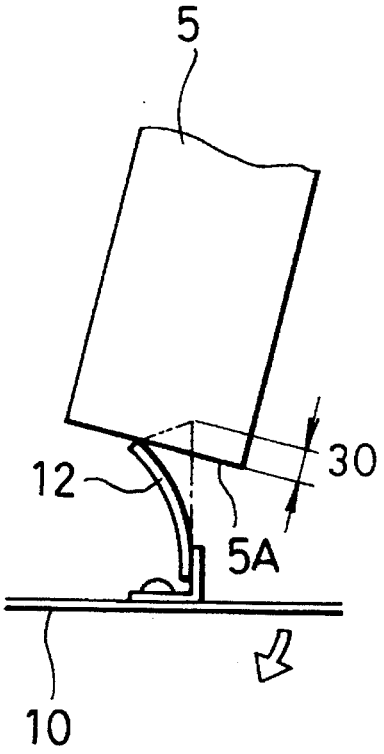
FIGS. 6A and 6B are views illustrating an amount of approach of the second embodiment.
Figure 6B:
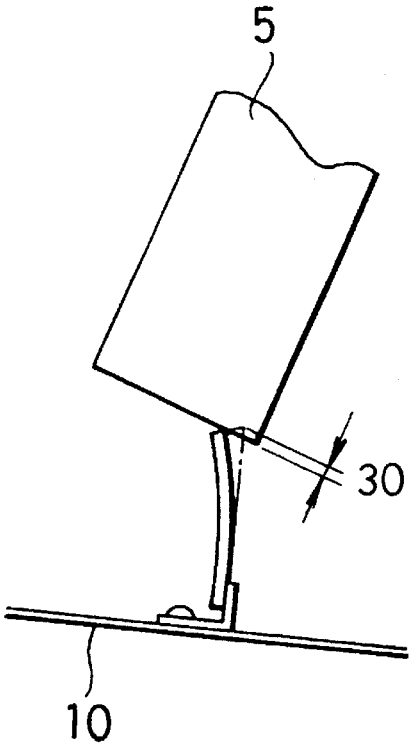

The second embodiment controls an amount of approach 30 of a wiping member 12 to an ink ejection portion 5A as shown in FIGS. 6A and 6B. The amount of approach 30 represents the strength of contact between the wiping member 12 and the ink ejection port ion 5A.

The control of the wiping operation of the second embodiment is similar to that of the first embodiment from step S11 to S15 except that the second embodiment does not control the speed of the rotation of a head unit 5 as in step S2 (and also steps S6 and S8) of the first embodiment.

At step S16, a cap unit 10 is moved relative to a head unit 5 from a position shown in FIG. 6A to a semi-escaped position shown in FIG. 6B so that the approach amount 30 of the tip of the wiping member 12 to the ink ejection portion 5A will be reduced. More specifically, the wiping member 12 projects so as to slide on the ink ejection portion 5A as shown in FIG. 6B, and the degree of the projection defines the approach amount 30. When the approach amount 30 is reduced, the splash of ink into the surroundings by the flick of the wiping member 12 slipping off the ink ejection portion 5A can be prevented. In particular, in the present embodiment, the fear can be eliminated that the recording sheet 4 as well as the periphery members will be spotted by ink for the following reasons: first, the wiping member 12 is placed apart from the recording sheet 4; second, the wiping member 12 flicks in the direction opposite to the recording sheet 4 because the wiping direction is opposite to the swing direction of the head unit 5 which moves toward the recording position; and third, the head unit 5 is rotated in the direction from the cap member 11 to the recording region.

At step S17, after completing the wiping, the cap unit 10 is rotated to the escaped position as shown in FIG. 2D. When it is confirmed that the head unit 5 is set at the recording position by a sensor or the like at step S18, the rotation of the head unit 10 is stopped at step S19, thus completing the wiping operation.

The present embodiment wipes the ink ejection portion 5A while the head unit 5 is rotating from the capping position to the recording position. Consequently, the angle when the wiping member 12 leaves the ejection portion 5A is small, which will reduce the friction between the two at this instant. As a result, a slight amount of ink may remain on the ink ejection portion 5A. This, however, will not adversely affect recording quality because the slight amount of remaining ink will be placed downstream of the ejection orifices, and hence even if the ink flows, it flows in a direction away from the orifices.

Although in this second embodiment described above, the rotation position of the cap unit 10 is controlled, the head unit 5 can be moved with the cap unit 10 being stationed at the predetermined wiping position so that the relative position control is achieved.

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to recording information; second, the thermal energy induces a sudden temperature rise that exceeds nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.– 70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese laid-open patent application Nos. 56847/1979 or 71260/1985. The present invention is most effective when it uses the film boiling phenomenon to expel the ink.

Furthermore, the ink jet recording apparatus of the present invention can be employed not only as an output device of a facsimile apparatus having a transmission and receiving function, but also as an image output terminal of an information processing device such as a computer, and as an output device of a copying machine including a reader.

The invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A wiping apparatus for a recording head of an ink jet recording apparatus, said recording head having an ink ejection portion and said recording apparatus having a capping member for covering said ink ejection portion of said recording head at a capping location outside a recording area to which said recording head can move for ejecting ink onto a recording medium from ink ejection orifices arranged on said ink ejection portion, said wiping apparatus comprising:

wiping means, comprising a wiping member of an elastic material, for wiping said ink ejection portion by sliding a tip of said wiping means on said ink ejection portion;

moving means for moving said recording head and said wiping means relative to each other so that said wiping means slides on said ink ejection portion to wipe said ink ejection portion when said recording head moves from said capping location toward said recording area; and control means for controlling a relative speed between said recording head and said wiping means while said wiping means is wiping said ink ejection portion to reduce said relative speed from an end of a wiping of said ink ejection orifices to a departing of said wiping means from said ink ejection portion as compared with said relative speed from a beginning to the end of the wiping of said ink ejection orifices.

2. A wiping apparatus as claimed in claim 1, wherein said moving means further comprises means for rotating said wiping means and/or said recording head so that an angle between said wiping means and said ink ejection portion is declined as the wiping proceeds.

3. A wiping apparatus as claimed in claim 1, wherein said recording head is a full-line recording head in which said ink ejection orifices are aligned in full length across said recording medium.

4. A wiping apparatus as claimed in claim 1, wherein said recording head comprises electrothermal converting elements which generate thermal energy for discharging ink from said ink ejection orifices.

5. A wiping apparatus as claimed in claim 1, wherein said control means further changes the relative speed after the end of the wiping of the ink ejection orifices.

6. An ink jet recording apparatus including an ink jet recording head, wherein said recording head performs recording on a recording medium at a recording area by discharging ink from an ink discharging orifice arranged on an ink ejection portion of said recording head, said ink jet recording apparatus comprising:

a capping member, mounted on said recording apparatus so as to be swingable relative to said recording head, for covering said discharging orifice at a capping location from which said recording head can move to said recording area;

wiping means, comprising a wiping member of an elastic material, for wiping said ink ejection portion by sliding a tip of said wiping means on said ink ejection portion;

moving means for moving said recording head and said wiping means relative to each other so that said wiping means slides on said ink ejection portion to wipe said ink ejection portion when said recording head moves from said capping location to said recording area; and control means for controlling a relative speed between said recording head and said wiping means while said wiping means is wiping said ink ejection portion to reduce said relative speed from an end of a wiping of said ink discharging orifice to a departing of said wiping means from said ink ejection portion as compared with said relative speed from a beginning to the end of the wiping of said ink discharging orifice.

7. An ink jet recording apparatus as claimed in claim 6, wherein said ink jet recording head comprises an electrothermal converting element which generates thermal energy for discharging ink from said ink discharging orifice.

8. An ink jet recording apparatus as claimed in claim 6, wherein said moving means rotates said wiping means.

9. An ink jet recording apparatus as claimed in claim 6, wherein the relative speed is a first speed during the wiping of the ink discharging orifice and changes to a second speed after the wiping of the said ink discharge orifice.

10. A method for wiping an ink jet recording head that performs recording on a recording medium by discharging ink from ink discharging orifices arranged on an ink discharging portion, said wiping being carried out after an end portion of an elastic member contacts the ink discharging portion as the recording head moves from a capping location where a capping member is disposed for covering the discharging portion to a recording areas where ink is discharged from the discharge orifices onto a recording medium, said method comprising the steps of:

starting wiping of the ink discharging portion by moving the recording head and the elastic member relative to each other at a first speed; and moving the recording head and the elastic member relative to each other at a second speed lower than the first speed to reduce said relative speed from an end of a wiping of said ink discharging orifices to a departing of said elastic member from said ink discharging portion as compared with said relative speed from a beginning to an end of the wiping of said ink discharging orifices.

11. A method as claimed in claim 10, wherein wiping of the ink discharging portion is performed by rotating the recording head and/or the elastic member.

12. A method as claimed in claim 10, wherein wiping is changed to the second speed after wiping the orifices at the first speed.

13. A wiping apparatus for a recording head of an ink jet recording apparatus, said recording head including an ink ejection portion and ink ejection orifices arranged on said ink ejection portion for ejecting ink from said ink ejection orifices to a recording medium, said wiping apparatus comprising:

wiping means, comprising a wiping member of an elastic material, for wiping said ink ejection portion by sliding a tip of said wiping means on said ink ejection portion;

moving means for moving said recording head and said wiping means relative to each other so that said wiping means slides on said ink ejection portion to wipe said ink ejection portion; and control means for controlling a relative speed between said recording head and said wiping means while said wiping means is wiping said ink ejection portion to reduce said relative speed from an end of a wiping of said ink ejection orifices to a departing of said wiping means from said ink ejection portion as compared with said relative speed from a beginning to the end of the wiping of said ink ejection orifices, wherein said moving means causes said wiping means and said recording head to rotate relative to each other so that an angle between said wiping means and said ink ejection portion is declined as the wiping proceeds.

14. A wiping apparatus as claimed in claims 13, wherein said recording head comprises electrothermal converting elements which generate thermal energy for discharging ink from said ink ejection orifices.

15. A wiping apparatus as claimed in claim 13, wherein said control means further comprises means for changing the relative speed after the end of the wiping of the ink ejection orifices.

16. A wiping apparatus for a recording head of an ink jet recording apparatus, said recording head including an ink ejection portion and ink ejection orifices arranged on said ink ejection portion for ejecting ink from said ink ejection orifices to a recording medium, said wiping apparatus comprising:

wiping means, comprising a wiping member of an elastic material for wiping said ink ejection portion by sliding a tip of said wiping means on said ink ejection portion;

moving means for moving said recording head and/or said wiping means so that said wiping means slides on said ink ejection portion to wipe said ink ejection portion; and control means for controlling a relative speed between said recording head and said wiping means while said wiping means is wiping said ink ejection portion to reduce said relative speed from an end of a wiping of said ink ejection orifices to a departing of said wiping means from said ink ejection portion as compared with said relative speed from a beginning to the end of the wiping of said ink ejection orifices, wherein said recording head makes contact with said wiping means while said recording head is moving from a position where said recording head faces a cap member covering said ink ejection portion to a position where said recording head faces said recording medium.

17. A wiping apparatus as claimed in claim 16, wherein said recording head comprises electrothermal converting elements which generate thermal energy for discharging ink from said ink ejection orifices.

18. A wiping apparatus as claimed in claim 16, wherein said control means further changes the relative speed after the end of the wiping of the ink ejection orifices.

19. A wiping method for a recording head of an ink jet recording apparatus having a capping member for covering an ink ejection portion of the recording head and a wiping member, the capping member being disposed at a capping location outside a recording area to which the recording head can move for ejecting ink onto a recording medium from ink ejection orifices arranged on the ink ejection portion, said wiping method comprising the steps of:

moving the wiping member and the recording head relative to each other at a relative speed so that the wiping member wipes the ink ejection portion by sliding on said ink ejection portion when the recording head moves from the capping location toward the recording area at a predetermined moving speed; and reducing the relative speed between the recording head and the wiping member during a latter part of wiping the ink ejection portion to reduce said relative speed from an end of a wiping of said ink ejection orifices to a departing of said wiping member from said ink ejection portion as compared with said relative speed from a beginning to an end of the wiping.

20. A wiping method as claimed in claim 19, wherein wiping of the ink ejection portion is performed by rotating the wiping member and/or the recording head.

21. A wiping method as claimed in claim 19, wherein wiping is changed to a second speed after wiping the orifices at the first speed.

22. A wiping method for a recording head of an ink jet recording apparatus having a capping member for covering an ink ejection portion of the recording head and a wiping member, the capping member being disposed at a capping location outside a recording area to which the recording head can move for ejecting ink onto a recording medium from ink ejection orifices arranged on the ink ejection portion, said wiping method comprising the steps of:

moving the wiping member and the recording head relative to each other at a relative speed so that the wiping member wipes the ink ejection portion when the recording head moves from the capping location toward the recording area; and reducing the relative speed between the recording head and the wiping member to reduce said relative speed from an end of a wiping of said ink discharging orifices to a departing of said elastic member from said ink discharging portion as compared with said relative speed from a beginning to an end of the wiping of said ink discharging orifices.

23. A wiping method as claimed in claim 22, wherein said moving step further comprises a step of rotating the wiping member and/or the recording head so that the wiping member wipes the ink ejection portion.

24. A wiping method as claimed in claim 22, wherein the relative speed is reduced in said reducing step from a first speed to a second speed after the wiping of the ink discharging orifices.

25. An ink jet recording apparatus including a wiping device for a recording head, wherein said recording head performs recording on a recording medium at a recording area by discharging ink from an ink discharging orifice arranged on an ink ejection portion of said recording head, said ink jet recording apparatus comprising:

a capping member, mounted on said recording apparatus so as to be swingable relative to said recording head, for covering said discharging orifice at a capping location from which said recording head can move to said recording area;

wiping means, comprising a wiping member of an elastic material, for wiping said ink ejection portion by sliding a tip of said wiping means on said ink ejection portion;

moving means for moving said recording head and said wiping means relative to each other so that said wiping means slides on said ink ejection portion to wipe said ink ejection portion when said recording head moves from said capping location to said recording area; and control means for controlling a relative speed between said recording head and said wiping means while said wiping means is wiping said ink ejection portion to reduce said relative speed from an end of a wiping of said ink discharging orifice to a departing of said wiping means from said ink ejection portion as compared with said relative speed from a beginning to the end of the wiping of said ink discharging orifice.

26. An ink jet recording apparatus as claimed in claim 25, wherein said ink jet recording head comprises an electrothermal converting element which generates thermal energy for discharging ink from said ink discharging orifice.

27. An ink jet recording apparatus as claimed in claim 25, wherein said moving means rotates said wiping means.

28. An ink jet recording apparatus as claimed in claim 25, wherein the relative speed is a first speed during the wiping of the ink discharging orifice and changes to a second speed after the wiping of the said ink discharge orifice.

29. An ink jet recording apparatus including a wiping device for a recording head, said recording head including an ink ejection portion and ink ejection orifices arranged on said ink ejection portion for ejecting ink from said ink ejection orifices to perform recording, said wiping device wiping said ink ejection portion of said recording head, said ink jet recording apparatus comprising:

wiping means, comprising a wiping member of an elastic material, for wiping said ink ejection portion by sliding a tip of said wiping means on said ink ejection portion;

moving means for moving said recording head and said wiping means relative to each other so that said wiping means slides on said ink ejection portion to wipe said ink ejection portion; and control means for controlling a relative speed between said recording head and said wiping means, said control means setting said relative speed at a first speed from a starting position at which said wiping means encounters said ink ejection portion in order to start wiping to an end position of wiping at which the wiping is completed, and at a second speed from said end position of wiping to a position at which said wiping means leaves said ink ejection portion, said second speed being set lower than said first speed.

30. A wiping apparatus as claimed in claim 29, wherein said recording head comprises electrothermal converting elements which generate thermal energy for discharging ink from said ink ejection orifices.

31. A wiping apparatus as claimed in claim 29, wherein said control means further changes the relative speed after the end of the wiping of the ink ejection orifices.

* * * * *

UNITED STATES PATENT AND TRADEMARK OFFICE

CERTIFICATE OF CORRECTION

PATENT NO. : 5,548,309

DATED : August 20, 1996

INVENTOR(S) : AKIO OKUBO ET AL.

It is certified that error appears in the above-identified patent and that said Letters Patent is hereby corrected as shown below:

On title page,

AT [56] REFERENCES CITED

Foreign Patent Documents,
"58-094472 11/1983 Japan" should read
--58-094472 6/1983 Japan--.

AT [57] ABSTRACT

Line 15, "technique" should read --techniques--.

SHEET 3 OF 6

FIG. 3, "TRASPORT" should read --TRANSPORT--.

COLUMN 2

Line 22, "is declined" should read --diminishes--.
Line 26, "is declined" should read --diminishes--.
Line 58, "during" should read --while--.

COLUMN 6

Line 59, "declines" should read --diminishes--.

COLUMN 7

Line 29, "port ion 5A." should read --portion 5A.--.

UNITED STATES PATENT AND TRADEMARK OFFICE

CERTIFICATE OF CORRECTION

PATENT NO. : 5,548,309

DATED : August 20, 1996

INVENTOR(S) : AKIO OKUBO ET AL.

It is certified that error appears in the above-identified patent and that said Letters Patent is hereby corrected as shown below:

COLUMN 8

Line 48, "to" should read --into--.
Line 53, "Patent Application Laying-open" should read --Laid-open Patent Application--.

COLUMN 11

Line 27, "areas" should read --area--.

COLUMN 12

Line 5, "claims 13," should read --claim 13,--.

UNITED STATES PATENT AND TRADEMARK OFFICE

CERTIFICATE OF CORRECTION

PATENT NO. : 5,548,309

DATED : August 20, 1996

INVENTOR(S) : AKIO OKUBO ET AL.

It is certified that error appears in the above-identified patent and that said Letters Patent is hereby corrected as shown below:

COLUMN 14

Line 45, "A wiping" should read --an ink jet recording--.
Line 50, "A wiping" should read --an ink jet recording--.

Signed and Sealed this

Twentieth Day of May, 1997

*Attest:*

*Attesting Officer*

Bruce Lehman

BRUCE LEHMAN

*Commissioner of Patents and Trademarks*